US006572238B1

(12) United States Patent
Johnson

(10) Patent No.: US 6,572,238 B1
(45) Date of Patent: Jun. 3, 2003

(54) ILLUMINATED DECORATIVE GARAGE DOOR ATTACHMENT ORNAMENT PANEL SYSTEM

(76) Inventor: Sandra Johnson, P.O. Box 274, Stafford, TX (US) 77477

( * ) Notice: Subject to any disclaimer, the term of this patent is extended or adjusted under 35 U.S.C. 154(b) by 0 days.

(21) Appl. No.: 09/678,874

(22) Filed: Sep. 4, 2000

(51) Int. Cl.[7] ..... E06B 1/34

(52) U.S. Cl. ..... 362/145; 362/147; 362/249; 362/252; 362/253; 52/3; 52/63

(58) Field of Search ..... 362/145, 147, 362/249, 252, 254, 253; 52/3, 63, 660

(56) References Cited

U.S. PATENT DOCUMENTS 4,537,806 A * 8/1985 Sherrard ..... 428/7
5,624,181 A * 4/1997 Miller et al. ..... 362/252
5,822,088 A * 10/1998 Danno et al. ..... 359/1
5,943,803 A * 8/1999 Zinbarg ..... 40/611
6,116,752 A * 9/2000 Mayfield et al. ..... 362/252
6,367,204 B1 * 4/2002 Eichler ..... 52/3

* cited by examiner

*Primary Examiner*—Sandra O'Shea
*Assistant Examiner*—Anabel Ton
(74) *Attorney, Agent, or Firm*—Darcell Walker

(57) ABSTRACT

An illuminated and decorative garage door cover assembly for use on an exterior surface of a garage door of the type having that contains an illuminated decorative display. The assembly can have a plurality of cover panels, each of which contains a portion of the display. The cover panels contain receptacles embedded therein that are electrically wired together. The receptacles receive lights that illuminate when power is applied to give an illuminated display. The display on the cover panels reflects holiday, seasonal, or other celebratory occasions. The display on the panels together when the garage door is in the closed position to form a composite display that is not colorful, but also illuminated to give greater appearance at night.

10 Claims, 4 Drawing Sheets

ILLUMINATED DECORATIVE GARAGE DOOR ATTACHMENT ORNAMENT PANEL SYSTEM

FIELD OF THE INVENTION

This invention relates to one or more panels containing a decorative image that can be affixed to a garage door. More particularly, this invention relates to illuminated decorative panels having seasonal, holiday, festive, or celebratory displays and are temporarily affixed to a movable garage door to provide an exterior decoration.

BACKGROUND OF THE INVENTION

During certain times of the year, holiday, seasonal, and festive decorative objects are very popular. For example, between the Thanksgiving and Christmas season, it is common to decorate one's home with decorative objects having a harvest or holiday theme, such as turkeys, cornucopias, snowmen, nativity scenes or Christmas trees. With the approach of the Easter holiday, images of Easter bunnies and crucifixion scenes are often included in residential decorative displays. In addition, when celebrating a birthday, anniversary, or a graduation, it is common to decorate the home with a celebratory display.

During the holiday season, one can see many homes and yards decorated to reflect the current season. Although of the house can be very well decorated, homes with front-facing garages often have a blank garage door. The garage door in many instances is the largest flat surface on the front of a house. This surface appears to be well suited for a large decorative display suitable for seasonal or festive events. One reason for the lack of decorations on a garage door is that the door is mechanical and must move up and down to operate. The use of decorative devices on the door could hinder the ability of the door to properly operate.

One solution is to have a flexible panel system that covers the surface of the door and provides a decorative scene without interfering with door operations. Permitting a garage door to open and close while covered with a decorative panel is not simple. It will be appreciated that a majority of garage doors are made of hinged door panels having lateral wheels that ride in a track. When a garage door is actively opening or closing, gaps are created between the panel at the hinges and the length of the garage door measured from the top-most door panel to the bottom-most door panel is relatively longer than when the door is in a closed position. Any decorative panel for a garage door must be able to remain on the exterior surface of the door and not be affected by the changes in lengths as the door is opened or closed.

A decorative panel system must be able to move from an open position to a closed position without buckling when closed or without getting caught in the gaps as the door is raised or lowered. Poorly designed panel systems will have a messy and undesirable appearance and may cause mechanical problems. A panel system too loose or too tight may not permit movement of the panel relative to the exterior surface of the garage door and may either prevent the garage door from fully opening or may cause inadvertent removal/tearing of the panel from the garage door when in operation.

U.S. Pat. No. 5,649,390 to Davidson describes a single panel flexible garage door cover, which when attached permits the garage door to open and close. The panel is draped over the front of a garage door and has upper and lower ends which extend around the upper and lower edges, respectively, of the garage door to the back of the garage door. The upper and lower ends of the panel are tethered together with elastic cords. As a result, when the garage door is opened, the elasticity of the cords permits movement of the panel relative to the garage door to allow the door to open. However, the door cover has several drawbacks. First, use of the cover requires a complicated and time consuming process to attach the webbing of elastic cords through eyelets in the cover and around axles of the garage door wheels. Second, the elastic cords place the cover, especially at the eyelets, under constant tension which requires the garage door cover to be made from a relatively thick flexible material. Third, when the door is an open position, the web of elastic cords extends between the upper and lower ends of the cover and thereby extends into the headroom of the garage. Fourth, the size of the single panel, which comprises the garage door cover, renders the cover relatively unsuitable for printing.

Since many garage doors are in segments, one approach to decorating a garage door is to use flexible decorative panels that cover the different garage door segments. These panels would fit together when the door is closed similar to a jigsaw puzzle. U.S. Pat. No. 5,943,803 to Zinbarg describes a garage door cover assembly for use on an exterior surface of a garage door of the type having a plurality of door panels permitted to rotate relative to each other when the garage door moves from a closed position to an open position is provided. The garage door cover assembly includes a plurality of horizontal cover panels and, for each cover panel, fixing members to couple the panel to a garage door panel. The cover panels are provided with fanciful holiday, seasonal, or other celebratory indicia. The indicia on the panels together form a composite illustration. According to a preferred embodiment of the invention, the cover panels are made from a flexible, waterproof polyethylene.

Zinbarg and other patent designs devote their attention to the means to attach a display to a garage door such that the display does not interfere with the operation of the door. Another concern with a garage door display is the visibility of the display. Most holiday displays are set in the front lawn of the house. In addition, the house decorations usually include lights to illuminate the display. Display lights get viewer's attention, enable people to better see the display and add to color and appearance of the display. Since a garage door is a large surface, lights on a garage door will make that display more visible at night. The previously mentioned patents do not discuss the issue of illuminating a garage door display. Therefore, there remains a need for an illuminated garage door display that can better present a garage door display at night.

SUMMARY OF THE INVENTION

It is an object of the present invention to provide a decorative garage door panel system that contains lights as part of the display.

It is another object of the present invention to have wiring in the display that connects the lights to a power source.

It is another object of this invention to have connectors that can enable a display that is implemented on a plurality of panels to be electrically connected to each other and to the power source.

It is a fourth objective of this invention to reflector type lights that do not require power to be illuminated.

It is another objective of the invention to provide a decorative garage door panel system which when attached to the surface of a garage door permits the garage door to open and close without the cover becoming detached.

It is another objective of the invention to provide a decorative garage door panel system that is held taut and has a clean appearance on the garage door.

It is a further objective of the invention to provide a decorative garage door panel system that is easy to attach to a garage door.

It is an additional objective of the invention to provide a decorative garage panel system that is easily removable from a garage door.

It is also an objective of the invention to provide a decorative garage door panel system, which, upon removal, will not damage a garage door to which it is attached.

Another objective of the invention is to provide a decorative garage door panel system which is inexpensive to manufacture and can be made of lightweight materials.

Another objective is to the invention is to provide a decorative garage door panel system that is safe to operate and will not hinder the normal use of a garage door.

It is still a further objective of the invention to provide a decorative garage door panel system that is waterproof.

The present invention provides a garage door cover assembly for use on an exterior surface of a garage door. This garage door cover contains lights installed as part of the cover display. These lights can be electrically connected to a power source that supplies power to illuminate the lights when desired. The type of garage door for which the garage door cover assembly is designed can have one or a plurality of door panels permitted to rotate (pivot) in a sequential fashion relative to each other when the garage door moves from a closed position to an open position. Wiring extends through or behind each panel and electrically connects light receptacles that hold the lights. In addition, connector means enable the various panels to be electrically connected in a series or parallel fashion to a power source. The garage door cover assembly can include a plurality of horizontal cover panels, each approximately the size of door panel of the garage, and, for each cover panel, fixing means to couple the panel to a garage door panel. The cover panels are provided with fanciful holiday, seasonal, or other celebratory indicia. Preferably the image on the panels forms a composite illustration.

Additional objects and advantages of the invention will become apparent to those skilled in the art upon reference to the detailed description taken in conjunction with the provided figures.

DETAILED DESCRIPTION OF THE INVENTION

Figure 1:
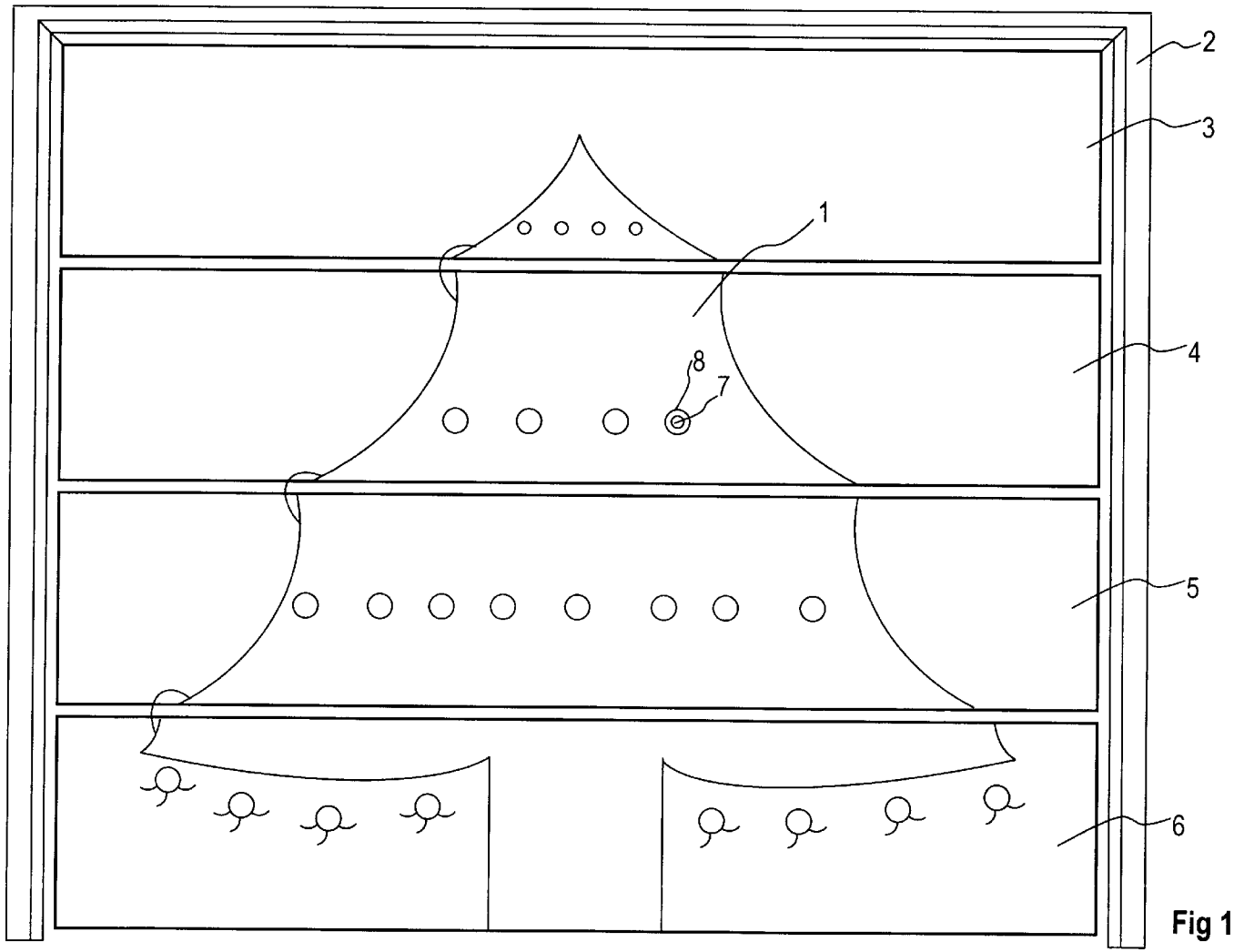
FIG. 1 is a perspective view of the front side of the garage door cover assembly of the invention attached to a garage door, which is in a closed position.

Referring to FIG. 1., a Christmas tree display 1 covers the garage door 2. Garage doors are generally made of three to four door panels. In this particular example, for the purpose of illustration, the garage door has four panels 3, 4, 5, and 6. These panels pivot relative to each other when the door moves between the open and closed positions. The display shown has four segments that are designed in accordance with the dimensions of the garage door. One segment covers each segment of the garage door. As the door comes down to close, the display segments come together to form the display similar to the pieces of a puzzle forming a picture.

Figure 2:
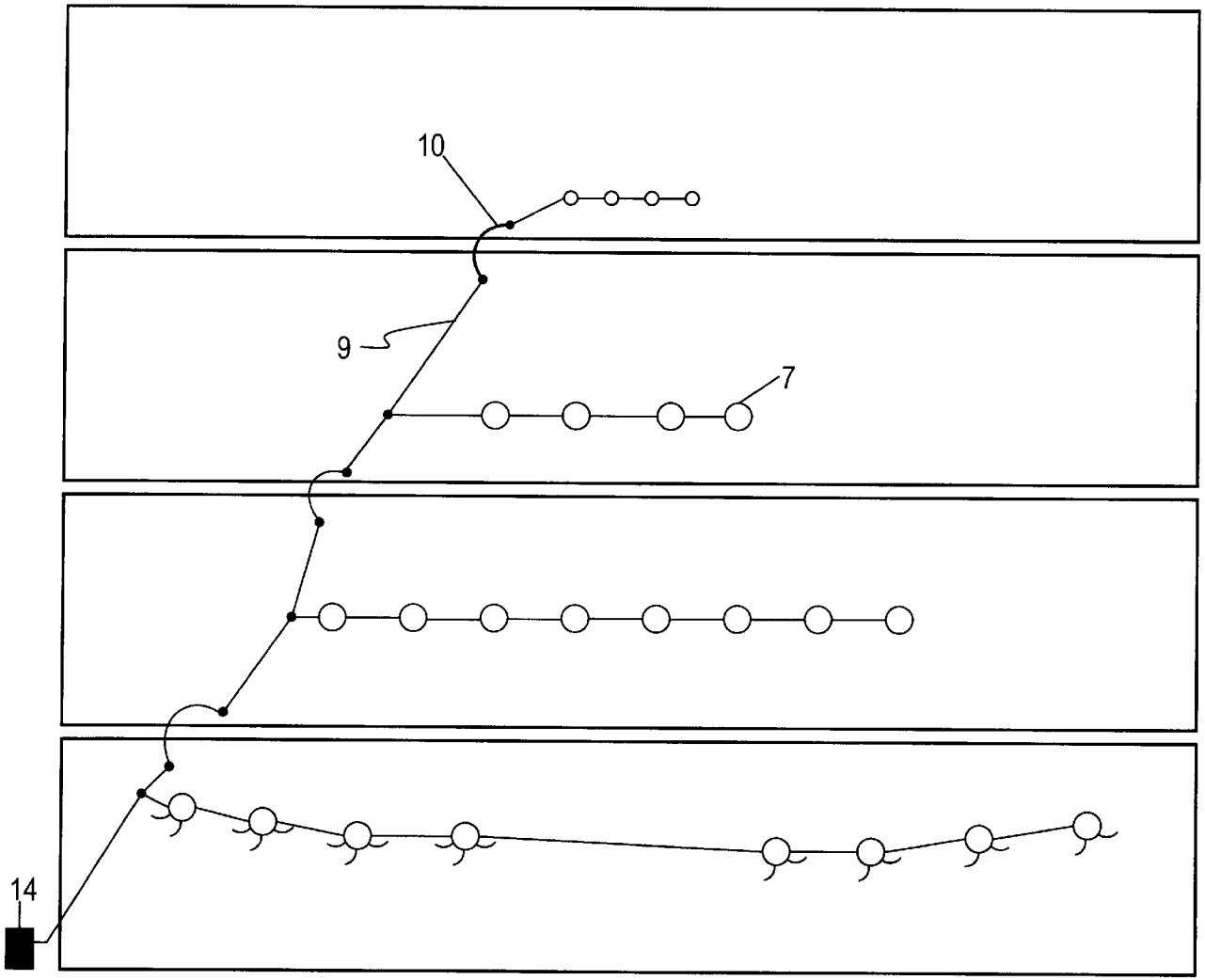
FIG. 2 is a perspective view of the backside of the garage door cover assembly showing the electrical wiring.

The display has on its front surface receptacles 7 (shown in FIG. 2) affixed to the segment surface to hold lights 8 as part of the display. Wiring electrically connects the receptacles. This wiring can run through the display and segment surface or behind the segment as shown in FIG. 2. In another embodiment, the lights can be embedded into the display with wiring running in the space between the backside of the display and the garage door.

FIG. 2 shows the backside of the garage door cover. The wiring 9 connects the receptacles 7 that hold the lights. The placement of receptacles is a function of the type of display. The receptacle placement pattern for this Christmas tree display is different from the placement pattern for a different display such as nativity scene. The wiring for each segment is separate. However, the wiring in each segment is connected by an adapter connector 10 to wiring in the other segments such as that an electrical circuit results. In FIG. 2, the circuit performs as 4 parallel circuits with one power source. This electrical configuration is similar many of the currently used light displays.

Figure 3:
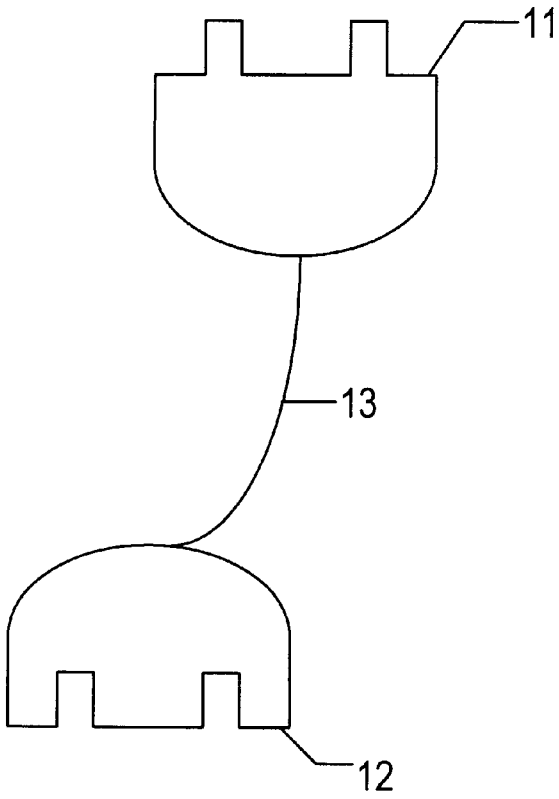
FIG. 3 shows a connector means to electrically connect lights in the different garage door panels.
Figure 4:
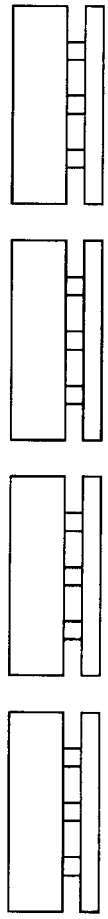
FIG. 4 is a side view of the garage door decorative cover assembly of the invention attached to a garage door which is in a closed position.

Referring to FIG. 3, the connectors 10 provide an electrical connection between the different panel segments. These connectors have adapters 11 that connect to adapters 12 at the ends to each wiring segment 13 in each display segment. A wire connects the adapters. This wire is of sufficient length such that it can be connected before the panels are attached to be garage door. The end of the wiring segment 13 of the bottom display segment can be plugged. to an electrical outlet 14 to supply power to the lights. The design for the wiring can be such that the lights can function in different display patterns such as blinking similar to Christmas lights on a tree or displayed on a house. Turning now to FIG. 4, which is similar to Zinbarg, a garage door decorative cover assembly 1 is shown attached to a garage door 2. It will be appreciated that garage doors are generally made from a plurality of door panels, e.g., four door panels 3, 4, 5, and 6 which are permitted to rotate (pivot) in a sequential fashion relative to each other when the garage door 2 moves from a closed position in FIG. 2 to an open position. The garage door 2 has an exterior surface 15 defined by the all-outer surfaces 16, 17, 18, and 19 of the garage door panels 3, 4, 5, and 6, respectively.

The garage door decorative cover assembly 1 is comprised of a plurality of cover panels, e.g., four cover panels 20, 21, 22, and 23, one for each door panel of the garage door 2 on which the cover assembly 1 is to be attached. With respect to one cover panel 20, each cover panel has a front surface 24 and a rear surface 25 and is preferably flexible and made from 1–2 mil sheets of waterproof plastic such as polyethylene. The cover panels 20, 21, 22, and 23 are attached to the garage door panels 3, 4, 5, and 6 using fixing means 44, which will now be described. As the garage door 2 is moved from an open position to a closed position, the cover panels remain in position and are not affected by the movement and position of the door panels.

According to a preferred embodiment of the invention, four flexible 1–2-mil polyethylene panels, each approximately 90 inches in width by 16 inches in height, are provided with sixteen fixing means (four per cover panel). The panels together depict a seasonal, holiday, or celebratory theme. In addition, the panels' cover may be cut with a standard scissors to customize the size of the panels to a particular garage door.

As stated in Zinbarg, while particular types of materials have been disclosed, it will be understood that other materials can be used as well. For example, and not by way of limitation, while polyethylene plastic is disclosed as a preferred material for the cover panels, other flexible materials such as polypropylene, polyvinyl chloride, paper, and fabric can be used. Moreover, substantially inflexible materials may also be used, such as cardboard, rigid plastic, or metal. Also, while it is preferable to use two pieces of adhesive at each end of each cover panel, it will be appreciated that one or more pieces of adhesive may be used at one end or across the top of each cover panel, and that, likewise, one or more pieces of adhesive may be used at the other end or across the bottom of each panel. Magnets may also serve as an attaching means for garage doors that have metal exteriors. In addition, while a non-marring adhesive is preferred for attaching the holding member and the panels to the exterior surface of the garage door, it will be appreciated that other fixing means may be used as well, e.g., staples, tacks, large-headed nails, other non-marring and removable adhesives in tape, foam mount, or other form, and, while not preferred, even marring or non-removable adhesives. In addition, a hook type upper end of each panel in a U-shape design can fit over each door panel to attach each door panel.

Figure 5B:
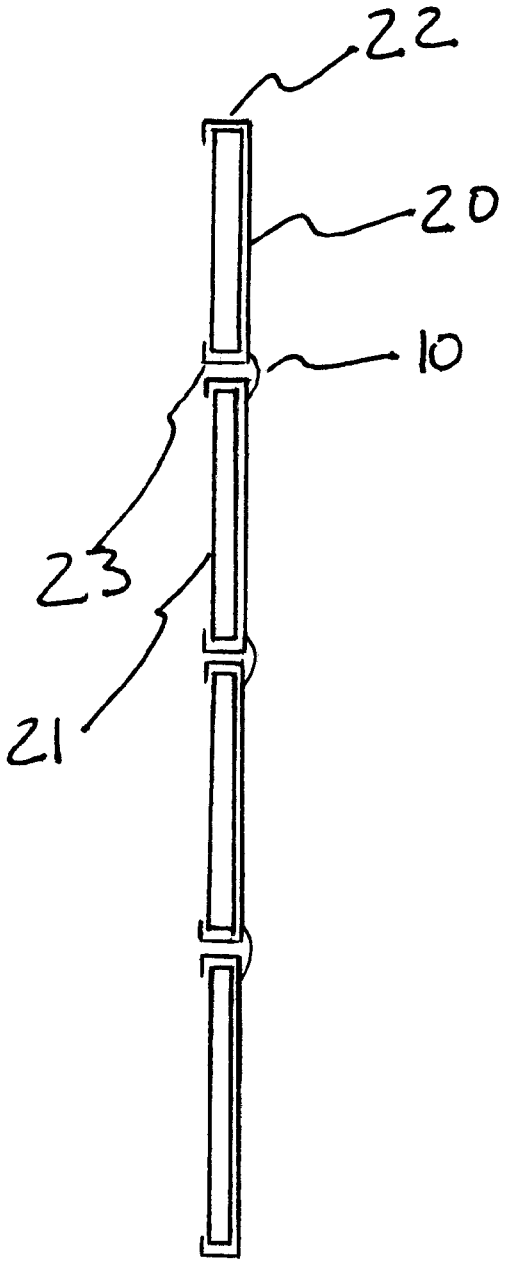
FIGS. 5*a* and 5*b* shoe a side view of the garage door decorative cover with one and both ends having a U-shape.
Figure 5A:
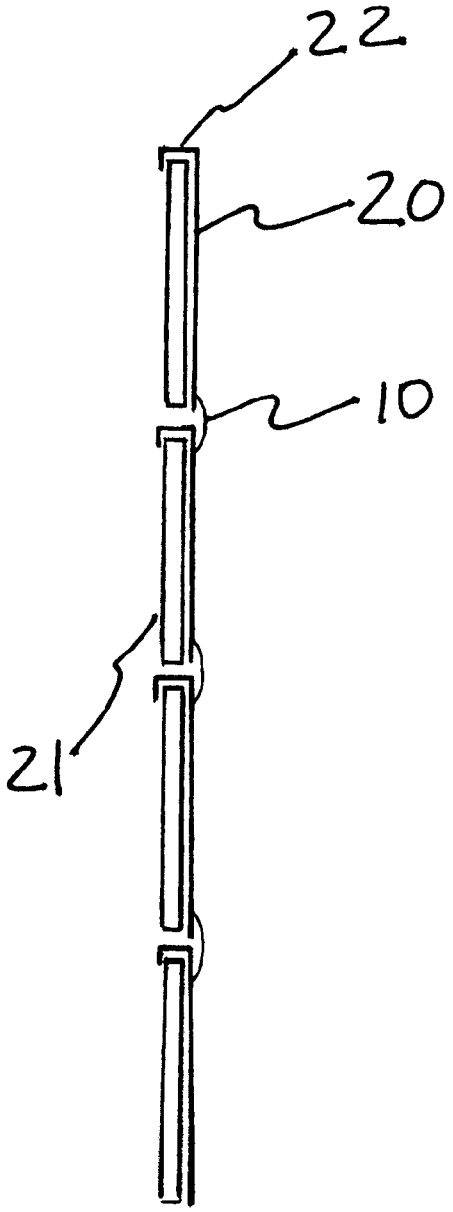

FIGS. 5*a* and 5*b* show alternate embodiments of panel ends designed to attach and secure panels 20 to the garage door segments 21. FIG. 5*a* shows a panel 20 with a U-shaped upper end 22. FIG. 5*b* shows a panel with U-shaped upper 22 and lower ends 23. The U-shaped ends can be of a material that is more rigid than the other portion of the panel. This rigid material can enable the ends of the panel to better engage the end of a door segment and provide a firm fit over the door. This firm fit provides a more secure attachment of the door panel of the present invention to the garage door segment. The means that attaches the panels to the garage door can be similar to those described in Zinbarg and are hereby incorporated by reference.

The invention can also be a one-piece canvass design that has lights. This canvass can be draped over the entire door. This design can also have lights embedded it and circuits that can illuminate the lights in the display on the canvass metal in manner similar to either embodiments of the present invention.

The present invention describes an illuminated and decorative garage door cover. The illuminated decorative garage door cover of this invention provides significant improvements over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. A garage door cover assembly having a decorative image for display on a garage door comprising:

a) a plurality of cover panels attached to corresponding and consecutive segments of a garage door, each of said cover panels being a continuous solid piece and having an interior surface and an exterior surface, and each of said cover panels covering a specific section of the garage door and each of said cover panels containing a specific portion of the decorative image such that the plurality of cover panels being attached to segments of the garage door in a specific order such that the decorative image is displayed on the garage door contained in the panels;

b) a plurality of lights attached to said cover panels such that said lights become part of the display;

c) wiring attached to said cover panels to electrically connect said lights in the display and to electrically connect said lights to a power source such that the lights illuminate the display when power is supplied to the lights, said wiring being hidden from the display by said solid cover panels; and d) electrical bridges that electrically connect wiring from portions of the decorative image located on adjacent cover panels.

2. The garage door cover assembly of claim 1 further comprising receptacles embedded in said plurality of cover panels and said receptacles being connected to said wiring, said receptacles being designed to receive said lights and thereby electrically connect said lights to the power source.

3. The garage door cover assembly of claim 2 further comprising a means to attach said cover panels to corresponding segments of a garage door.

4. The garage door assembly of claim 3 wherein said cover panels are made of a flexible material.

5. The garage door cover assembly of claim 3 wherein said attaching means removably attaches said interior surfaces of said cover panels to the corresponding segments of the garage door.

6. The garage door cover assembly of claim 1 wherein said cover panels have dimensions that are substantially the same as the dimensions of corresponding garage door segments.

7. The garage door cover assembly of claim 4 wherein said cover panels further comprise upper and lower U-shaped ends, said upper and lower ends being more rigid than the other portion of the panel in order to firmly attach the cover panels to the upper and lower ends of the garage door segments.

8. The garage door cover assembly of claim 1 wherein said lights and receptacles are attached to said cover panels in a pattern based on the particular display on the door panels.

9. The garage door cover assembly of claim 1 wherein one of said plurality of said cover panels has an opening to accommodate a garage door handle.

10. The garage door cover assembly of claim 4 wherein said cover panels further comprise an upper U-shaped end, said upper end being more rigid than the other portion of the panel in order to firmly attach the cover panels to the upper end of the garage door segments.

* * * * *